United States Patent [19]

Spring, Sr. et al.

[11] 3,989,113

[45] Nov. 2, 1976

[54] PNEUMATIC TOOL HAVING A REVERSE AIR CONTROL VALVE WITH AN INTEGRAL REGULATOR

[75] Inventors: Edward F. Spring, Sr., Mohawk; Raymond J. Schaedler, Utica, both of N.Y.

[73] Assignee: Chicago Pneumatic Tool Company, New York, N.Y.

[22] Filed: Aug. 25, 1975

[21] Appl. No.: 607,377

[52] U.S. Cl. ..... 173/163; 173/169; 137/625.69; 251/285

[51] Int. Cl.[2] ..... F01D 1/30

[58] Field of Search ..... 173/163, 12, 169; 251/285; 137/625.69; 415/152 R, 503

[56] References Cited

UNITED STATES PATENTS

| | | | |
|---|---|---|---|
| 2,586,906 | 2/1952 | Beckett et al. | 251/285 X |
| 3,347,270 | 10/1967 | Cranage | 173/169 X |
| 3,515,225 | 6/1970 | States | 173/12 |
| 3,572,447 | 3/1971 | Pauley | 173/12 |
| 3,624,820 | 11/1971 | Brown | 415/152 |
| 3,718,313 | 2/1973 | Miller | 173/169 X |
| 3,721,266 | 3/1973 | Ikebe et al. | 137/625.69 |
| 3,734,459 | 5/1973 | Sauerwein et al. | 251/285 |
| 3,833,068 | 8/1974 | Hall | 173/169 |

*Primary Examiner*—Ernest R. Purser
*Assistant Examiner*—Richard E. Favreau
*Attorney, Agent, or Firm*—Stephen J. Rudy

[57] ABSTRACT

A nut running air tool improved with a back and forth manually slidable control valve located between a throttle valve and an air motor, the control valve having a forward position allowing full volume air flow to the motor and maximum forward torque output, a reverse position allowing full volume air flow to the motor and maximum reverse torque output, and the control valve having integral manipulative means for adjusting its effective length so as to permit it to be moved to a third position allowing a restricted volume air flow to the motor and restricted forward torque output.

14 Claims, 7 Drawing Figures

FIG. 5
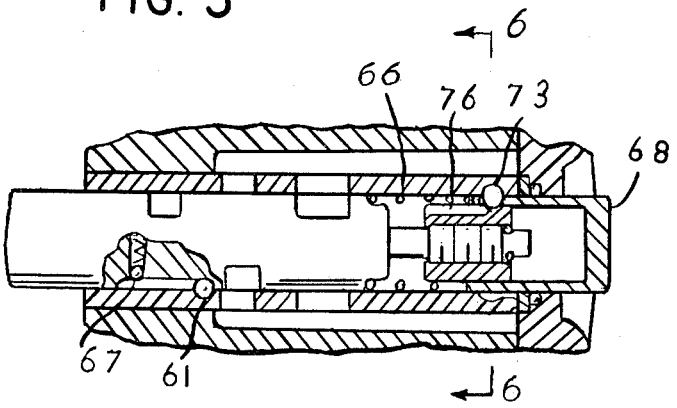
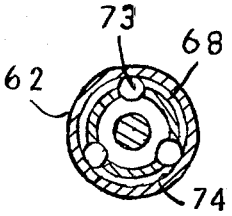
FIG. 6
FIG. 7
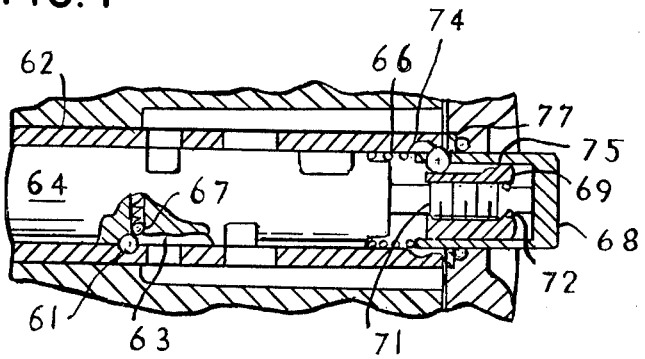

PNEUMATIC TOOL HAVING A REVERSE AIR CONTROL VALVE WITH AN INTEGRAL REGULATOR

BACKGROUND OF THE INVENTION

This invention is concerned with the improvement of a pneumatically driven nut running tool, such as an impact wrench, with directional torque selector mechanism which enables the operator to effect a change in the torque output value of the tool as needed according to the work involved and the intended torquing direction.

A tool of this improved nature is especially desirable for wheel work in auto service stations in applying or removing fasteners such as lug bolts, as well as in other applications.

The full torque capacity of the tool is often required in a reverse direction to remove overtightened or frozen lug bolts; whereas a lesser torque is desired to be applied at times in a forward direction to avoid overtightness and possible damage to components of the vehicle such as the rotor in disc brake applications when installing the bolts.

A general object of the invention is to provide a pneumatically driven nut running tool, such as an impact wrench, with directional torque and torque value control means which will enable the operator to select not only the direction of torque output but also to regulate the value of the output.

A further object is to provide in a rotary impact wrench a directional flow control valve of the back-and-forth push type for controlling the direction of air flow to the motor of the tool and having integral regulatory means for controlling the volume of air flow to the motor.

In accordance with the invention there is provided a pneumatically powered nut running tool comprising a reversible rotary air motor, a throttle valve for admitting supply air to the tool, a manually slidably positionable control valve located between the throttle valve and the motor for controlling directional application and volume of supply air flow to the motor, the control valve being slidable to a first position in which it directs supply air at full volume flow from the throttle valve to a forward driving side of the motor and being slidable to an opposite second position in which it directs supply air at full volume flow from the throttle valve to a reverse driving side of the motor, manipulative means carried by the control valve selectively operable for adjustably shortening the length of the control valve, and the control valve in its adjusted condition being slidable to a third position in which it directs supply air at a reduced volume flow from the throttle valve to the forward driving side of the motor, means for preventing sliding of the control valve beyond its first and second positions, and other means for preventing sliding of the control valve in its adjusted condition beyond its third position.

BRIEF DESCRIPTION OF DRAWING

In the accompanying drawing:

FIG. 5 is view corresponding to that of FIG. 2, but showing a modified form of the control valve in its forward position;

FIG. 6 is a section on line 6—6 of FIG. 5; and

FIG. 7 is a view showing the control valve of FIG. 5 in its reverse position.

DESCRIPTION OF PREFERRED EMBODIMENT

Figure 1:
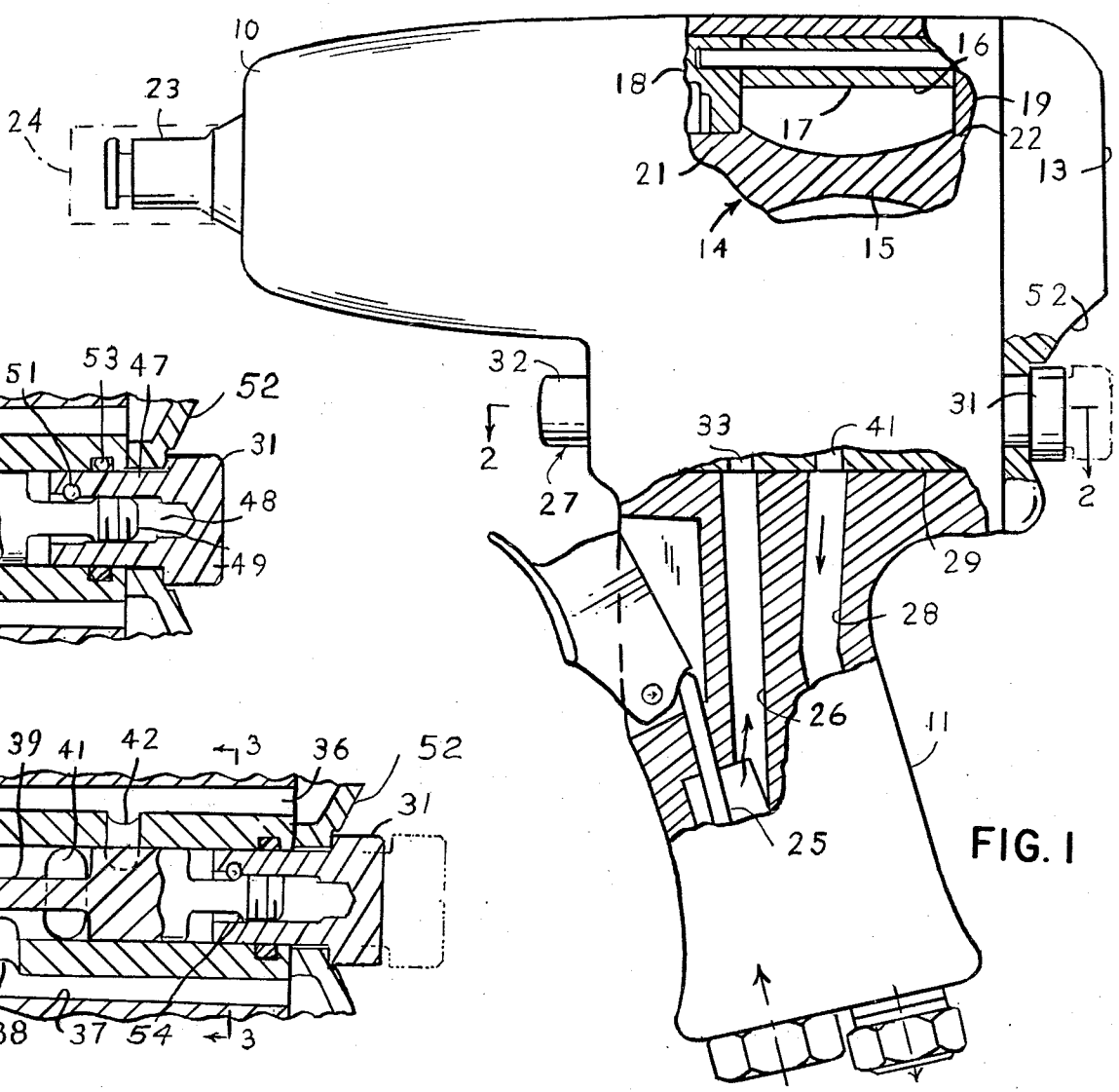
FIG. 1 is a side elevational view of a pneumatic impact wrench in which the invention is incorporated, portions of the tool being cut away for added illustration.
Figure 3:
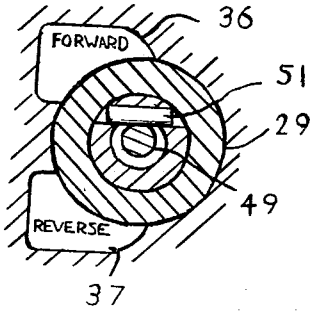
FIG. 3 is a section on line 3—3 of FIG. 2.
Figure 4:
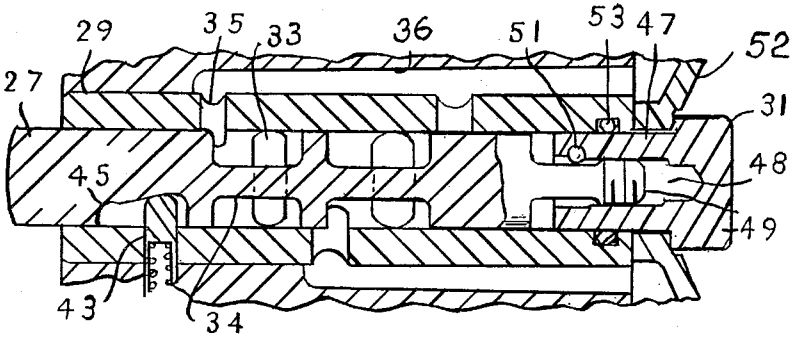
FIG. 4 is a view similar to that of FIG. 2 but showing the control valve in a selected adjusted position allowing a restricted volume air flow to the forward driving side of the motor.

Attention is directed to the several Figures of the drawing, and now especially to FIGS. 1–4 wherein the invention is illustrated as embodied in a pneumatically powered impact wrench. The tool has a general housing 10 provided with a depending pistol grip handle 11. Supported in the housing adjacent the inner face of a cap or cover section 13 of the housing is a motor assembly 14 of a conventional reversible rotary air driven vane type.

The motor assembly includes the usual reversible rotor 15 which is rotatable in conventional manner in a chamber 16 in either a forward or reverse direction accordingly as live supply air is fed to either of the usual forward and reverse directional areas of the motor chamber. The motor chamber is defined by an open ended liner 17, the ends of which are closed by the usual pair of end plates 18 and 19. The rotor has the usual axially projecting shaft ends 21, 22 supported in bearings fitted in the end plates. The forward shaft end 21 is drivingly coupled by the usual train of gearing, not shown, to a spindle 23 upon which a lug bolt engaging socket 24, broken line, is carried, whereby a lug bolt when engaged by the socket may be set or loosened.

A throttle valve 25 located in the handle of the tool is actuable by the operator to cause admission of live air from an external supply into an inlet passage 26 of the tool. A control valve 27 located in the handle between the throttle valve and the motor controls the application of the admitted air from the inlet passage to a selected directional side of the motor, and controls the exhaust of spent air from the opposite side of the motor to an exhaust passage 28 in the handle.

The control valve is of spool form; it is supported in the upper portion of the handle. It is manually slidable back and forth in a bushing 29 relative to various ports for communicating the inlet passage 26 and the exhaust passage 28 with opposite sides of the motor. It is slidable in a forward direction by manually depressing inwardly a rearwardly projecting knob 31 carried by the valve; and it is slidable in a reverse direction by manually depressing a forwardly projected end 32 of the valve.

Figure 2:
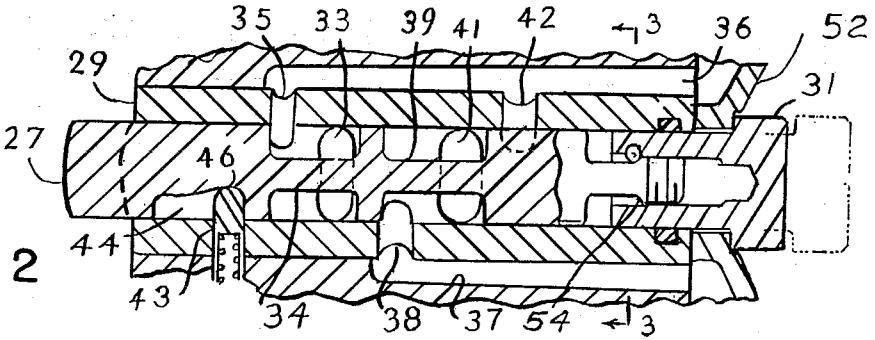
FIG. 2 is a section taken on line 2—2 of FIG. 1 showing the combined air flow direction and air volume control valve in its forward position allowing full volume flow to the forward driving side of the motor.

The control valve has a full forward position, as in FIGS. 1 and 2, in which an inlet port 33 in the valve bushing connected with the inlet passage 26 communicates around a neck or first groove 34 of the valve with an outlet forward port 35 leading through a passage 36 in the housing to the forward side of the motor. In this full forward position of the valve a passage 37 from the reverse side of the motor leads through a reverse port 38 into the bushing and connects around a second groove 39 of the valve with an exhaust port 41 from the bushing opening into the exhaust passage 28 extending through the handle. In the full forward position of the control valve there is a full volume air flow to the forward driving side of the motor causing application of a maximum torque to the work.

The control valve has a full reverse position, as indicated by the broken line in FIGS. 1, 2, in which the inlet port 33 connects around the groove 34 of the valve with the reverse port 38 leading through passage 37 to the reverse side of the motor. In this reverse position the forward side of the motor connects through passage 36, a bushing port 42 and around the second groove 39 with the exhaust port 41.

A spring loaded detent 43, slidably projecting from the housing wall through the bushing into a longitudinally extending recess 44 in the body of the valve, is cooperable with one or the other of a pair of radial pockets 45 and 46 at opposite ends of the recess to determine and releasably restrain the control valve in its full forward or reverse positions. The detent has a rounded pilot end which engages in the rear or deeper pocket 46 to arrest the control valve in its full forward position, as appears in FIG. 2; and which engages in the other pocket 45 to arrest the valve in its reverse position. An inclined bottom wall of the recess connecting the pockets rides over the detent against the bias of the detent spring as the valve is moved from one position to the other. The detent also cooperates with the side walls of the recess to restrain the control valve from rotating relative to its bushing 29.

Adjustable means, as will now be described, is provided to reduce or adjust the effective length of the control valve so as to enable it to obtain a limited or less than its full forward position, in which limited position a restricted volume air flow will be applied to the forward side of the motor and, as a consequence, a lesser or limited torque will be applied to the work. This limited or less than full torque application is desired in various situations, such as when it is desired to apply a limited or less than full torque in tightening the lug bolts in automotive disc brake applications.

This adjustable means includes the knob 31 and its cooperative association with the control valve 27. The knob has a shank portion 47 slidably extending into the rear of the valve bushing 29 and having an internal threaded recess 48 engaging a threaded axially extending stem 49 of the control valve. The knob is threadedly adjustable along the stem of the valve to obtain an increase or decrease in the effective length of the valve so as to vary the moved relation of the valve to the various ports in the bushing. The detent 43 in cooperation with the detent recess 44 restrains the valve against rotation relative to the bushing so as to enable the knob to be threaded along the valve stem. A laterally extending retainer pin 51 in the shank of the knob is cooperable with an annular shoulder 54 on the valve stem to prevent an outward adjustment of the knob free of the valve.

It is to be noted that in the full forward position of the control valve (FIGS. 1, 2) the knob 31 is seated in an external cavity 52 in the back wall or cap 13 of the tool, so that there is an inadequate or inconvenient space for easy finger manipulation of the knob to make an adjustment of the valve. Accordingly, when it is desired to make an adjustment of the control valve to cause application of a limited torque to the work, the valve is first moved to its reverse position where the knob is displaced sufficiently away from the back wall of the tool to allow convenient manual turning of the knob, as appears by the broken line in FIG. 1.

While the control valve is in its reverse position, the adjustment is made by turning the knob clockwise (FIGS. 1, 2) a prescribed distance. The knob is then thumb-pressed forwardly until it seats in the cavity 52 against the back wall of the housing of the tool. The effective length of the control valve, that is the portion extending forwardly beyond the shank of the knob, will have been reduced by the adjustment. The adjusted control valve now will, when depressed forwardly, obtain the limited forward position shown in FIG. 4. In the limited forward position of the control valve the body of the valve will partially cover over the forward outlet port 35 leading to the forward side of the motor. Accordingly, the volume air flow from the inlet port 33 around the groove 34 will be restricted in passing through port 35, thus resulting in a limited torque being applied to the work in a forward direction. The adjustment made to the control valve will not affect the full volume flow to the reverse driving side of the motor when the valve is moved to its reverse position.

While the control valve is in its limited forward position, vibration developing during operation of the tool might tend to cause the knob 31 to rotate relative to the valve stem out of its adjusted position. However, an O-ring 53 seated in the bushing in surrounding friction contact with the periphery of the shank portion of the knob serves to counteract this tendency.

SECOND EMBODIMENT (FIGS. 5–7)

A modification of the control valve unit is shown in FIGS. 5–7. In this form a retaining pin 61 having a fixed position in a control valve bushing 62 extends across a flat 63 on the surface of the control valve 64. The pin determines the full forward position of the valve when a rear shoulder of the flat abuts against the pin, as in FIG. 5. A return spring 66 exerting a forward bias upon the valve serves to hold the valve in its full forward FIG. 5 position.

Pin 61 also determines the full reverse position of the control valve, as in FIG. 7, when the valve is moved rearwardly until a forward shoulder of the flat abuts the pin. A spring loaded ball detent 67 projecting upwardly through the flat is adapted, as appears in FIG. 7, to obtain a position to the rear of the pin as the valve is moved to its full reverse position and, in doing so, the detent yieldably serves to restrain the valve from being returned to its forward position by the return spring 66.

Further, in this modified form the means for making an adjustment of the control valve to obtain a limited forward position of the latter for effecting application of a limited forward torque to the work, includes a sleeve knob 68 associated with a separable adjustable nut 69 threaded upon the stem 71 of the valve. A retainer ring 72 curbs the nut against being adjusted free of the valve stem.

The nut is axially slidable in the sleeve portion of the knob 68; and the sleeve portion in turn is disposed in the valve bushing 62 for relative rotation and axial sliding movement. The return spring 66 limits between an inner end of the sleeve portion of the knob and an opposed end of the valve, whereby the valve and knob are constantly biased in opposite directions.

A group of balls 73 function in a forward position of the control valve, as in FIG. 5, to latch the knob against relative rotation and axial movement. In a reverse position, FIG. 7, of the valve the balls provide a driving spline connection between the knob and the nut 69 to enable the making of an adjustment of the control valve for obtaining a limited forward position of the latter and consequent application of limited forward torque to the work.

The balls 73, here three in number, are spaced equally apart circumferentially; and each is located in a separate hole in the sleeve portion of the knob. In the full forward position of the control valve (FIGS. 5, 6) the outwardly protruding portions of the balls are seated in a pocket defined by an annular groove 74 in the surrounding bushing 62; and inwardly protruding portions of the balls are seated against individual inside radiused shoulders 75 of the nut. The forward bias of spring 66 on the valve serves to pressure the shoulders of the nut against the balls so as to hold the latter engaged in pocket 74.

Extending forwardly from each radiused shoulder 75 of the nut is a longitudinal spline groove 76. It can be seen that, when the control valve is thumb-pressed rearwardly from the FIG. 5 position to its FIG. 7 reverse position, the radiused shoulders 75 of the nut will be carried away from the balls as the nut is carried by the valve rearwardly into the sleeve portion of the knob. In this action the rearward force of the spring 66 acting through the sleeve portion upon the balls will cause the balls to be released from the pocket 74 into the spline grooves 76 of the rearwardly moving nut. Release of the balls causes the knob to be moved rearwardly by the spring relative to the housing until slightly outwardly protruding portions of the balls abut against a stop ring 77. And, when the valve has been fully advanced to its reverse position, it will be yieldably latched in such position by the cooperation of the detent 67 with the rear side of the retainer pin 61.

The release of the balls into the spline grooves 76 provides a rotary driving spline connection between the knob and the nut; and the rearwardly moved condition of the knob facilitates manual gripping thereof to effect an adjustment of the control valve. In making the adjustment, rotation of the knob for a prescribed distance in a clockwise direction acts through the balls in its sleeve portion and the spline grooves to cause travel of the nut along the valve stem 71 and a consequent drawing or adjustment of the valve into the sleeve of the knob. In this driving of the nut the valve is restrained from rotating with the nut by means of the flat 63 and retaining pin 61.

As a result of the adjustment made of the nut the effective length of the control valve is correspondingly reduced. This adjustment will not affect the volume of air flow to the reverse side of the motor since the full reversed condition of the valve is not changed. However, when the control valve is depressed forwardly, the adjusted valve will restrict flow of inlet air to the forward side of the motor. When the knob 68 is depressed in this action to position the valve in its limited forward position the balls 73 re-engage in the pocket 74 and the spring 66 acting through the valve returns the nut to re-position its shoulders 75 against the balls.

We claim:

1. In a hand held nut running tool including a housing having a spindle engageable with a threaded fastener, a reversible rotary air motor for imparting forward and reverse torque to the spindle accordingly as live air is applied to a forward or reverse side of the motor, and a throttle valve for admitting live air to the housing; a manipulative control valve located between the throttle valve and the motor for controlling the directional application and volume flow of the live air to the motor, the control valve being movable to a first position allowing a full volume air flow from the throttle valve to the forward side of the motor, the control valve being movable from the first to an opposite second position allowing a full volume air flow from the throttle valve to the reverse side of the motor, and means for adjusting the effective length of the control valve so as to enable it to be moved to a third position short of its first position in which a restricted volume air flow is allowed from the throttle valve to the forward side of the motor, the control valve as adjusted being movable from its third position to its second position allowing a full volume air flow from the throttle valve to the reverse side of the motor.

2. A pneumatically powered nut running tool comprising an air driven reversible motor, a throttle valve for admitting supply air to the tool, and a control valve disposed between the throttle valve and the motor selectively slidable for communicating supply air from the throttle valve to either a forward or a reverse driving side of the motor, the control valve being manually slidable in a forward direction to a first position in which it allows a full volume air flow from the throttle valve to a forward driving side of the motor and being manually slidable in an opposite direction to a second position in which it allows a full volume air flow from the throttle valve to a reverse driving side of the motor, and manually adjustable means effective only for limiting the extent of manual movement of the control valve in the forward direction to a third position short of the first position in which third position the control valve allows a restricted volume air flow from the throttle valve to the forward driving side of the motor.

3. A pneumatically powered nut running tool comprising a reversible rotary air motor, a throttle valve for admitting supply air to the tool, a manually slidably positionable control valve located between the throttle valve and the motor for controlling directional application and volume of supply air flow to the motor, the control valve being slidable to a first position in which it directs supply air at full volume flow from the throttle valve to a forward driving side of the motor and being slidable to an opposite second position in which it directs supply air at full volume flow from the throttle valve to a reverse driving side of the motor, manipulative means carried by the control valve selectively operable for adjustably shortening the length of the control valve, and the control valve in its adjusted condition being slidable to a third position in which it directs supply air at a reduced volume flow from the throttle valve to the forward driving side of the motor, means for preventing sliding of the control valve beyond its first and second positions, and other means for preventing sliding of the control valve in its adjusted condition beyond its third position.

4. A pneumatically powered nut running tool as in claim 3, including a bore in which the control valve is slidable, the bore having a supply air inlet port, a first port connecting the bore with the forward side of the motor, a second port connecting the forward side of the motor with the bore, a third port connecting the bore with the reverse side of the motor, and an exhaust port from the bore, the control valve in its first position having a peripheral groove communicating the inlet port fully with the first port and a second peripheral groove communicating the reverse side of the motor with the exhaust port.

5. A pneumatically powered nut running tool as in claim 4, wherein the second position of the control valve the first peripheral groove communicates the inlet port fully with the third port and the second peripheral groove communicates the second port with the exhaust port.

6. A pneumatically powered nut running tool as in claim 4, wherein a spring loaded detent is cooperable with a pocket at one end of a longitudinally extending recess in the control valve to prevent sliding of the control valve beyond its first position.

7. A pneumatically powered nut running tool as in claim 5, wherein the spring loaded detent is cooperable with another pocket at an opposite end of the longitudinally extending recess to prevent sliding movement of the control valve beyond its second position.

8. A pneumatically powered nut running tool as in claim 3, wherein the manipulative means carried by the control valve that is selectively operable for adjustably shortening the length of the control valve comprises a knob having an internal threaded connection with an axially extending stem of the control valve whereby rotation of the knob in a predetermined direction relative to the stem causes the stem of the valve to be drawn into the knob.

9. A pneumatically powered nut running tool as in claim 8, wherein a spring loaded detent is cooperable with sides of a longitudinally extending recess in the control valve to restrain rotation of the control valve so as to permit the relative rotation of the knob.

10. A pneumatically powered nut running tool as in claim 8, wherein the other means for preventing sliding of the control valve in its adjusted condition beyond its third position comprises an external shoulder on the knob that is cooperable with a back wall of the tool.

11. A pneumatically powered nut running tool as in claim 8, wherein the knob includes a sleeve shank in which is received a nut threaded upon the stem of the control valve.

12. A pneumatically powered nut running tool as in claim 11, wherein the sleeve is axially slidable relative to the nut, and ball elements disposed in holes in the sleeve have an outwardly protruding position engaged in a pocket of the bore in the first position of the valve whereby the knob is restrained against rotation with the nut.

13. A pneumatically powered nut running tool as in claim 12, wherein the control valve is normally biased by a spring load to its first position in which position shoulders on the nut abut against portions of the balls protruding inwardly of the sleeve shank.

14. A pneumatically powered nut running tool as in claim 13, wherein spline grooves in the nut extend forwardly from the shoulders, the control valve is slidable rearwardly against the spring load to carry the nut and as a consequence displace the shoulders inwardly of the sleeve shank away from the balls, and the balls upon displacement of the shoulders being adapted to drop free of the pocket and to seat their inner protruding portions into the spline grooves so as to provide a rotary ball spline driving connection between the sleeve shank and the nut.

* * * * *